US005868128A

United States Patent [19]

Omar

[11] Patent Number: 5,868,128

[45] Date of Patent: Feb. 9, 1999

[54] FIREPIT

[76] Inventor: Amad Omar, 3477 Ruffin Rd., #2I, San Diego, Calif. 92123

[21] Appl. No.: 940,749

[22] Filed: Sep. 30, 1997

[51] Int. Cl.[6] ..... F24C 3/00

[52] U.S. Cl. ..... 129/512; 126/519; 126/305

[58] Field of Search ..... 126/25 R, 41 R, 126/38, 512, 519, 304 R, 304 A, 305, 306, 40, 50; 431/125

[56] References Cited

U.S. PATENT DOCUMENTS

| | | | |
|---|---|---|---|
| D. 258,259 | 2/1981 | Lindholm | D7/107 |
| D. 273,264 | 4/1984 | Elliston | D7/332 |
| 3,582,250 | 6/1971 | Chatfield | 126/512 |
| 3,722,498 | 3/1973 | Kimbrough | 126/38 |
| 4,446,846 | 5/1984 | Hahn | 126/25 |
| 4,706,817 | 11/1987 | Greathouse | 126/25 R |
| 4,922,887 | 5/1990 | Foxford | 126/25 |
| 5,094,223 | 3/1992 | Gonzalez | 126/25 |
| 5,203,316 | 4/1993 | Pritchett | 126/29 |
| 5,421,318 | 6/1995 | Unruh | 126/25 |
| 5,421,321 | 6/1995 | Ward | 126/512 |
| 5,596,980 | 1/1997 | Whalen | 126/519 |

*Primary Examiner*—James C. Yeung
*Attorney, Agent, or Firm*—Frank G. Morkunas

[57] ABSTRACT

A firepit apparatus for which controlled flames from lava rocks may be visibly displayed includes a base portion having an elevated platform on which lava rocks are supported. Surrounding the platform is a wall of sufficient height to laterally contain layered lava rocks. This surrounding wall extends below the platform to elevate the platform. Legs attached to the interior of the wall are used to provide further support for the platform. On this platform, a gas line with a multiplicity of spaced outlet ports is disposed. This gas line is attached to an apertured junction which transverses the platform, which is in turn attached through a regulated line to a regulator valve, and ultimately through a supply line to a supply source of gas, such as a pressurized natural gas or liquid petroleum canister or tank. Attached to the base portion is a lid support structure that is substantially open to the sides to allow clear view of lava rocks placed on the platform of the base portion even when a lid is used. With the present firepit, a controlled fire may be safely displayed in almost any outdoor space, including residential areas of urban and suburban locales.

20 Claims, 4 Drawing Sheets

FIREPIT

BACKGROUND OF THE INVENTION

1. Field of the Invention

The present invention relates to a firepit apparatus. More specifically, the present invention relates to a gas fire pit apparatus for generating heat and visible flames with lava rocks.

2. Description of the Prior Art

The warm glow and flickering flames of controlled fire has soothed and comforted humankind from prehistory. Though fire is useful for cooking meals and providing heat, optimization to such ends usually has detracted from the simple joys derived from watching and feeling fire in a more or less natural state. To a certain degree, fireplaces can recapture some of this in an indoor environment. In the outdoors there are campfires, but the making of these are usually only possible in wilderness areas, and therefor not practicable without a planned outing to appropriate locales As aforementioned, fire has been optimized for cooking meals. The prior art includes numerous examples of gas grilling apparatuses for cooking purposes. For example, U.S. Pat. No. 4,446,846, issued May 8, 1984 to L. Hahn describes a table top grill that includes various grates between which lava rocks or the like are held to provide sufficient cooking heat. Flames are controlled to different areas through valves in the gas inlet from a pressurized source. Other portable cooking devices are described by U.S. Pat. Nos. 4,922,887, issued May 8, 1990 to K. Foxford; 5,203,316, issued Apr. 20, 1993 to W. Pritchett; and 5,421,318, issued Jun. 6, 1995 to Unruh et al. Though these prior art patents do describe some of the elements used in the present invention, for which they are hereby incorporated by reference, they do not provide for the aesthetic, comforting, and entertaining display of fire for which use the present invention is primarily directed.

Fire pits useful for burning inserted wood have also have been the subject of prior patents. For example, U.S. Pat. No. 5,094,223, issued Mar. 10, 1992 to L. Gonzalez describes a portable fire pit in which gas is fed from a pressurized source to a medially disposed ring which direct gas flames inwardly towards vertically arranged wood. A grill placed over the wood is used for grilling food. In this apparatus, the use of screens is necessary to prevent falling wood from exiting the apparatus. This detracts from the usefulness of the apparatus as a fire display. Further, the apparatus requires wood of sufficient length to extend at least from the bottom tensor of the apparatus to the ring. Designs for similar screened fire pits are shown in U.S. Pat. No. Des. 273,264, issued Apr. 3, 1984 to M. Elliston; or U.S. Pat. No. Des. 258,259, issued Feb. 17, 1981 to M. Lindholm.

None of the above references are seen to describe the present nvention as shown, described, and/or defined by the following pecification, drawings, and claims.

SUMMARY OF THE INVENTION

The present invention relates to a firepit apparatus for which controlled flames may be visibly displayed, and the derived warmth sufficiently felt to provide an enjoyable, inviting atmosphere for outdoor settings. Particularly, the present invention is ideally suitable for use in more populated areas, such as patios, decks, and the like, as found in residential areas of urban or suburban locales.

The present firepit includes a base portion having an elevated platform on which lava rocks are supported. Surrounding the platform is a wall of sufficient height to laterally contain at least one layer of lava rocks. Preferably, the wall is sufficiently sized such that a couple of layers of lava rocks may be contained. This surrounding wall may be extended below the platform to elevate the platform, and/or a multiplicity of legs attached thereto for such purpose.

On this platform, a gas line having a multiplicity of spaced outlet ports is disposed. This gas line is attached to an apertured junction which transverses the platform, which is in turn attached through a regulated line to a regulator valve, and ultimately through a supply line to a supply source of gas, such as a pressurized natural gas or liquid petroleum canister or tank. The gas line is arranged on the platform in spaced relation with the surrounding wall to provide evenly distributed gas to lava rocks, placed on the platform. Accordingly, a serpentine and/or coiled path may be defined by the gas line.

Attached to the base portion is a lid support structure that is substantially open to the sides to allow clear view of lava rocks placed on the platform of the base portion. This support structure may include both horizontal and vertical support members, and may be firmly secured to the base portion through any convenient means at any convenient point or points. Preferably, positive securement through groove and lip friction fit and/or through screws at a multiplicity of points around the base portion are used. These allow the support structure to be disassembled from the base portion for facilitating cleaning, moving, or storage. On the lid support structure, a lid is disposed, which may be permanently, or releasably, secured to the support structure. Alternatively, the base portion, the support structure, and the lid may be partially or wholly made unitarily.

With the present firepit, a controlled fire may be safely displayed in almost any outdoor space, including residential areas of urban and suburban locales. The provision of a wall structure prevents lateral displacement of lava rocks due to wind or physical abutment from exiting the present apparatus. Further protection is provided by the lid. With this combination of structures, any wind or other lava rock displacing vectors would be directed either safely into the platform or the wall of the base portion of the present invention. Despite these positive containment provisions, the flames produced by the lava rocks may be seen without any substantial obstruction by all around the present firepit.

Accordingly, it is a principal object of the invention to provide an entertaining and comforting fire display apparatus in the form of a firepit for lava rocks and the like.

It is another object of the invention to provide such an apparatus which may be safely and efficiently used in a multiplicity of outdoor settings, including patios, decks, or the like in residential areas.

It is a further object of the invention to provide a firepit apparatus which may be easily transported between sites.

Still another object of the invention is to provide a firepit apparatus which provides nearly unobstructed view of flames from lava rocks placed therein.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
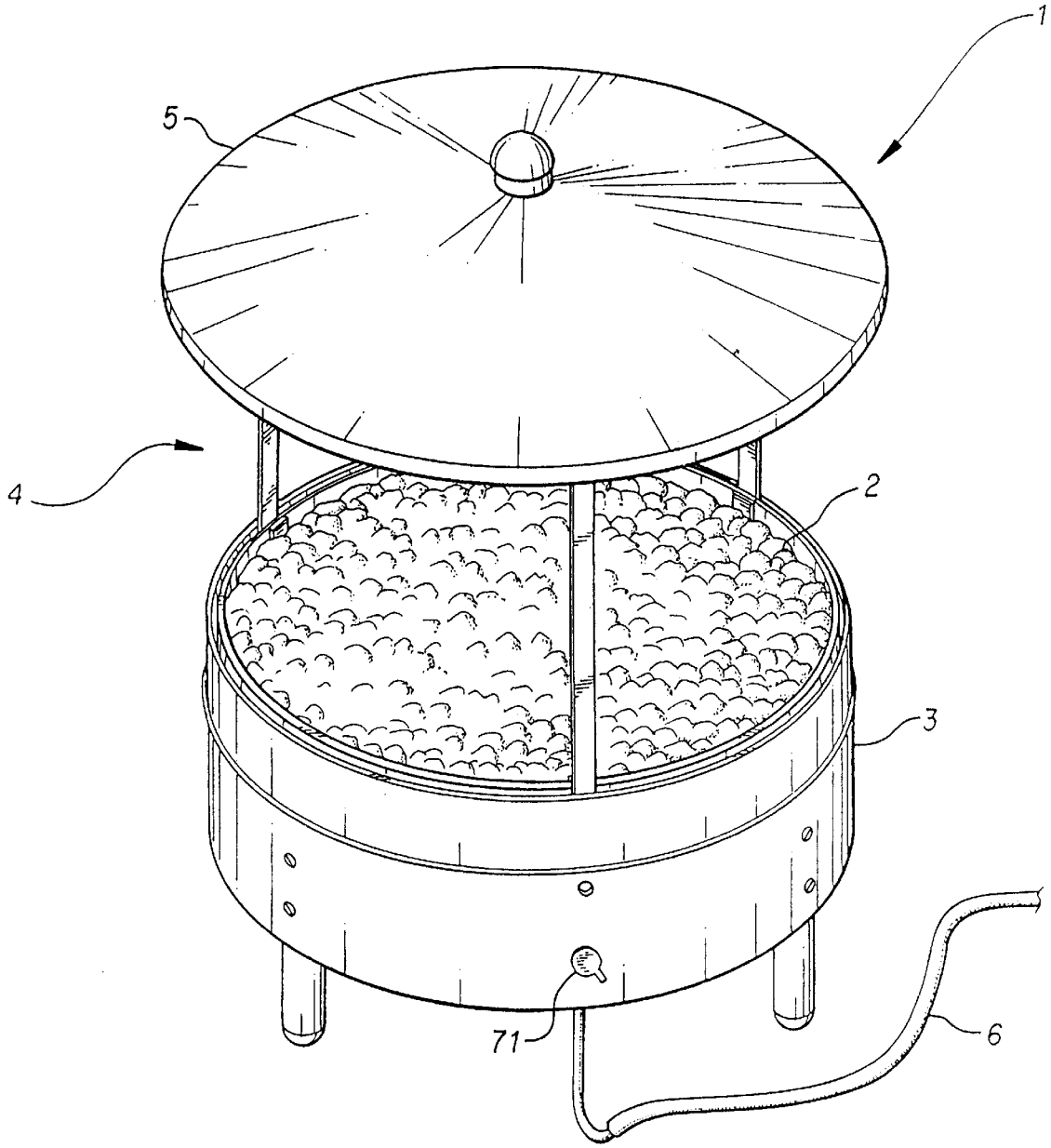
FIG. 1 is a perspective view of a preferred embodiment of the present firepit.

As seen in FIG. 1, the present invention is a firepit 1, in which lava rocks 2, or the like are contained in a base portion 3. Extending from the base portion is a lid support structure 4. On this lid support structure is disposed a lid 5. Gas is supplied to the lava rocks through supply line 6 from a source, such as a pressurized canister (not shown). A regulator valve 7, manipulated through valve knob 71 allows the amount of gas entering the present apparatus to be controlled.

Figure 2:
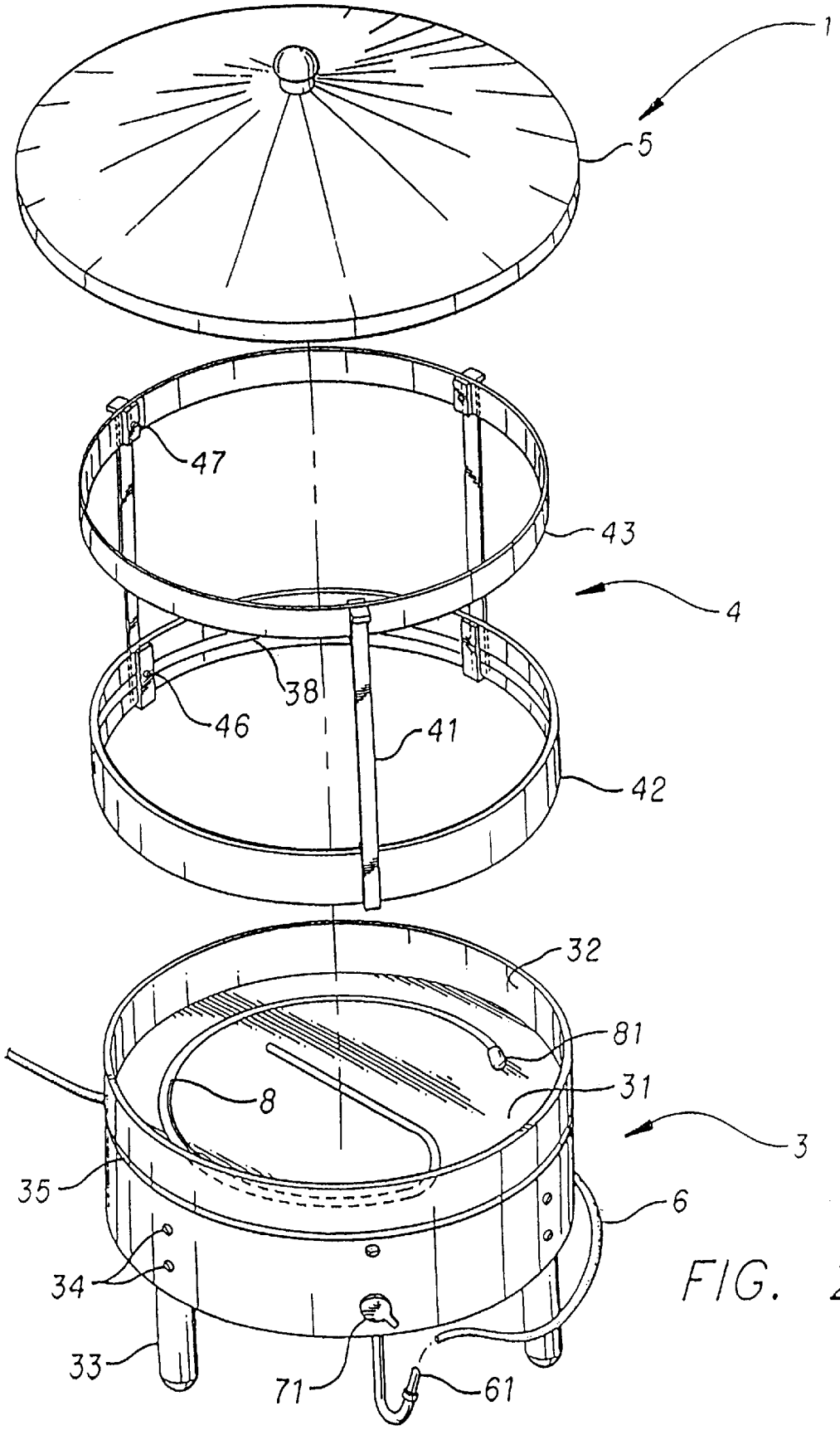
FIG. 2 is a perspective plan view of the same.

As better seen in FIG. 2, base portion 3, includes an elevated platform 31, a wall structure 32, and optionally a plurality of legs 33 secured to the wall structure, such as to the interior through screws 34 as shown. On platform 31, a coiled gas line 8 is disposed to evenly distribute gas to a space defined by platform 31 and the portion of interior of wall 32 extending upward vertically from the platform. This space as defined is sized to provide adequate confinement of lava rocks in a plurality of layers.

Lid support structure 4 may include both vertical support members such as struts 41, as well as horizontal support members, such as rings 42, and 43, along with securement means such as screws 46 and 47. This support structure may be sized to securely fit by frictional engagement of ring 42 and/or struts 41 within the interior of wall 32 as shown, or over the exterior of wall 32. Alternatively and/or in addition securing mechanisms such as screws 46 may be used to attach the support structure to the base portion through corresponding holes defined in wall 32. As better seen in FIG. 3, wall 32 may include a horizontal groove 35 which may be mated with a corresponding tongue 38 of the lid support structure 4 for better securement thereto. The horizontal groove 35 operates as a lid-support connector and the corresponding tongue 38 operates as a receiver for the lid-support connector. It should be understood, however, that the horizontal groove 35 and the corresponding tongue 38 may reciprocally be on the wall 32 or on the lid support structure 4, respectively.

Figure 3:
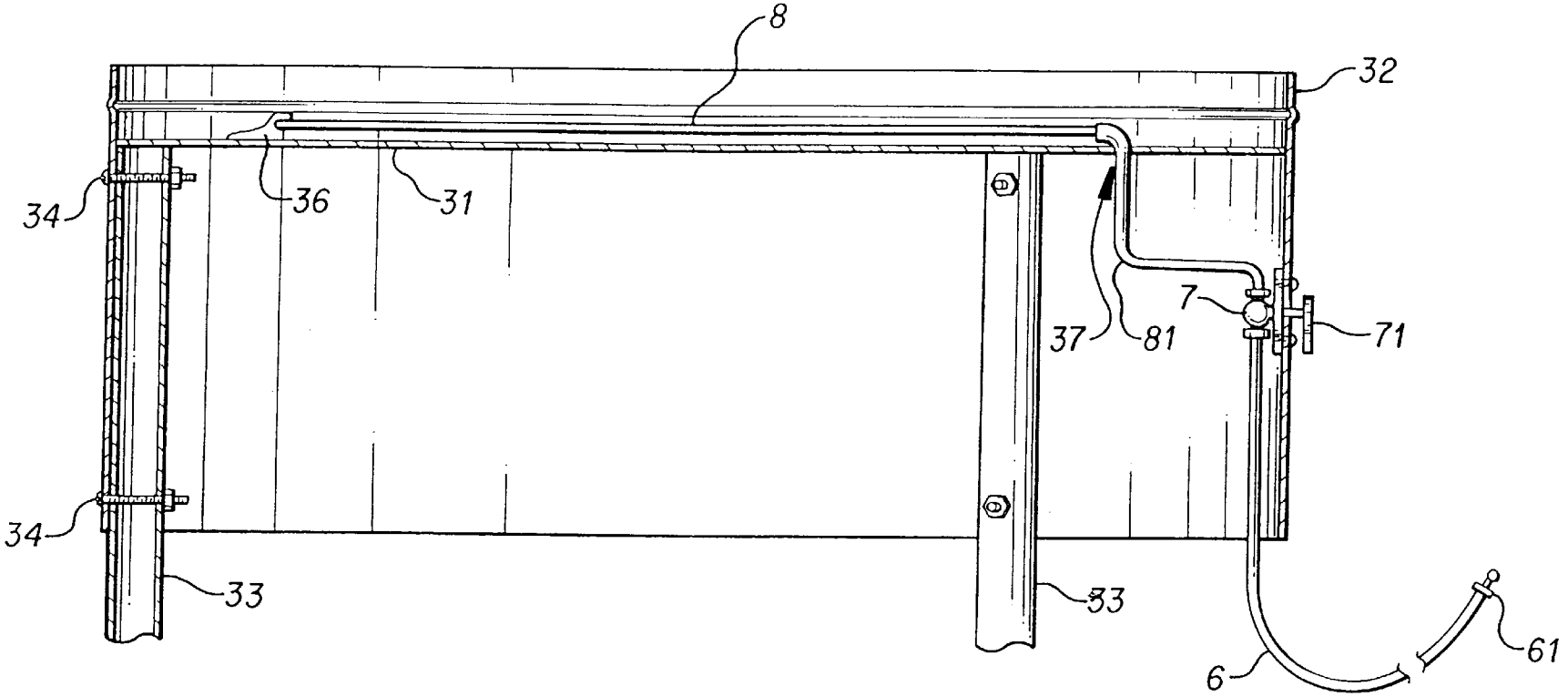
FIG. 3 is a side cut-away view showing the base portion of the same.
Figure 4:
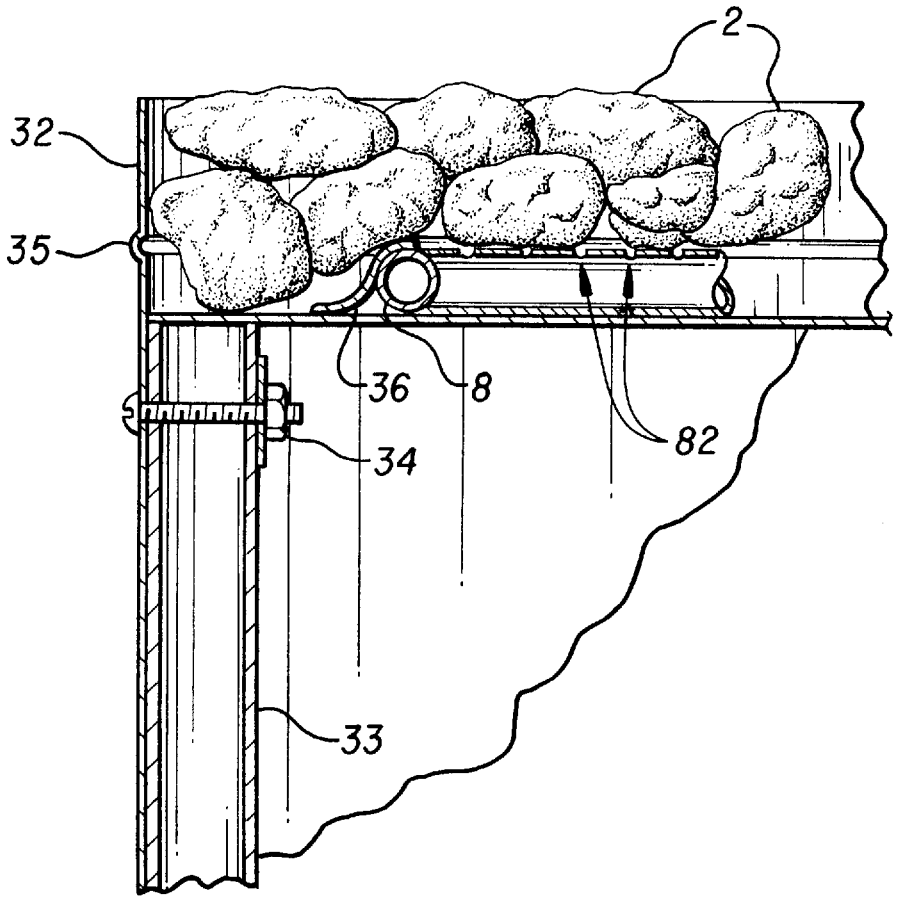
FIG. 4 is a partial side cut-away environmental view showing lava rocks disposed in the base section of the same.

Also seen in FIG. 3 is the general path through which gas flows from a supply source to a gas line 8. Gas line 8 may be secured to platform 31 through one or more bracket elements 36. A junction 81 passes through aperture 37 defined in platform 31; and connects gas line 8 to regulator valve 7. Alternatively, gas line 8 may be formed unitarily with platform 31, with junction 81 connected thereto. From the regulator valve, supply line 6 is connected to a supply source. Supply line 6 may include one or more connectors 61 for greater flexibility. Connectors 61 are preferably of the quick-release type to ease assembly/disassembly with various gas supply sources and/or supply line extensions. As best seen in FIG. 4, gas line 8 includes numerous spaced outlet ports 82 through which gas is supplied to lava rocks 2.

Advantageously, the wall 32 and platform 31 of base portion 3, the struts 41 and rings 42,43 of lid support structure 4, and even lid 5 of the present firepit may be constructed from cut sheet metal, such as steel sheeting. Preferably, steel sheeting of heavy gage, (e.g. 18 gage) is used. Depending on the size of the firepit desired, a circumference of platform 31 is first determined and the platform is cut from the sheet. This circumference may be in the range of 1 meter to 10 meters. An aperture 37 sufficient in size to accommodate junction 81 is made into the platform. Gas line 8 is then secured to platform 31, with an open end proximate aperture 37 Sheet metal cutouts may also be used for bracket elements 36 for supporting and securing gas line 8 to the platform 31.

A rectangular strip of greater length than the platform circumference, and a width corresponding to the desired height of the wall 32 is cut, looped into a cylinder and secured. The cylinder defined by wall 32 should be sized to snugly receive platform 31 in its annular space. Alternatively, the rectangular strips may be aquired pre-cut to width and/or length, such as conventionally available 1 inch wide, ⅛ inch thick stock. Regulator valve 7 may then be attached to the interior of this annular space, under platform 31. Junction 81 is then thread through platform 31 to connect gas line 8 to regulator valve 7.

Legs 33 may be aquired as pre-made stock in various lengths, thicknesses, and diameters. For example, 1 to 2 inch diameter cylindrical legs may be aquired in convenient lengths. Alternatively, they may be made from the same sheet metal. The configuration of the legs may be cylindrical as shown in FIG. 3, but need not be. As seen in this figure, the legs may be secured to the interior of wall 32 in abutting contact with platform 31. This provides additional stability to the platform, and increases its weight bearing capacity. The length of legs 33 determines the height off the ground or other resting surface for platform 31.

Rectangular strips of a length equal or slightly greater than he platform circumference are then cut for rings 42 and 43, which are then looped to form continuous cylindrical structures, with any excess length overlapped for convenient securement by any appropriate means, such as soldering, riveting, or with screws.

Struts 41 are then cut to a length at least corresponding to the height desired between lid 5 and platform 31. Additional length for struts may be used to double over a ring to which it is attached, such as shown in FIG. 2, in which strut 41 is doubled over to receive ring 42, and screw 46 is used to secure 41 to 42. Additional length may also be used to form a brace for lid 5. As also seen in FIG. 2, the top portion of strut 41 is bent outward to form a horizontal support surface for lid 5. Again, pre-cut stock materials may be used for struts 41 as well as rings 42 and 43, such as comercially available 1 inch wide, ⅛ inch thick steel stock.

The sheet metal parts used may be painted or otherwise coated/lined with refractory and/or fireproof materials and paints, both to protect the metal from environmental contact, and to provide superior heat transfer properties to the ambient air, and/or insulative properties to the base metal. Though the present invention is primarily directed to providing a pleasing firepit display for entertainment purposes, the heat generated by the burning of lava rocks also enhances the overall atmospheric effect of the present invention. Further the use of paints, coatings, and linings may further enhance the aesthetic appeal of the present invention.

The preferred embodiment of the present invention as shown in the drawings has the further advantageous of being easily disassembled and made compact for storage and/or transport. With the detachment of struts 41 from rings 42 and 43, the entire lid support structure may be placed in the annular space defined by wall 32, under platform 31. The legs 33 may also be detached and placed therein. Sufficient space may remain for placement of a portable source of gas, such as a small pressurized canister. Lid 5 may then be dropped to cover and protect gas line 8, and may be dimensioned to snugly engage wall 32 above platform 31. Straps or a separate bottom cover may be used to retain the disassembled elements under platform 31. (Not shown)

It is to be understood that the present invention is not limited to the any single embodiment described above, but encompasses any and all embodiments within the scope of the following claims. For example, various parts may be cast separately or unitarily with others rather than cut from sheet metal. The materials used may be varied so long as they have the desired characteristics of fire resistance, at least in those parts of the invention which are in contact with or close proximity to lava rocks placed therein. Accordingly, ceramic, cementitious, stone, brick, or high melting point polymers/composites may be used in at least some parts of the present firepit.

Further the basically circular and cylindrical configuration described may be modified without departing from the spirit of the present invention to any desired configuration to suit decor and space considerations, including polygonal and other rectilinear forms, as well as curvilinear forms such as ovoids.

I claim:

1. A firepit for the controlled containment and display of burning lava rocks, said firepit comprising:

a base portion having a platform and a platform surrounding wall, said platform and wall extending above and below said platform defining a space for a plurality of said lava rocks support on said platform and defining a storage area below said platform, said base portion being substantially open at a top plane;

a lid;

a lid support structure non-connectably attachable to said base portion and to said lid, said lid support structure extending from the base portion, said lid support structure openly configured to provide a substantially unobstructed view of said platform and any lava rocks supported on said platform;

a gas line for providing fuel to said lava rocks, said gas line disposed upon the platform of said base portion;

a supply line for supplying said gas line with fuel from a source of fuel; and a regulator disposed between said gas line and said supply line for controlling the quantity of gas to said supply line.

2. The firepit of claim 1, wherein said regulator includes a regulator valve disposed beneath said platform, a regulator control in communication with said regulator valve, and a junction connecting said regulator valve to said gas line through an aperture defined in said platform.

3. The firepit of claim 2, wherein said regulator control is a knob is disposed on the exterior of said base portion.

4. The firepit of claim 1, wherein said lid support structure includes vertical support elements.

5. The firepit of claim 4, wherein said vertical support elements include a plurality of struts extending from said base portion to support said lid.

6. The firepit of claim 5, wherein said lid support structure further comprising horizontal support elements.

7. The firepit of claim 6 in which said horizontal support elements include at least a first ring secured to a basal part of each of said struts.

8. The firepit of claim 7 wherein said first ring with said struts attached thereto is sized to snugly fit within said wall of said base portion, above said platform.

9. The firepit of claim 6 in which said horizontal support elements include at least a second ring secured to each of said struts, distal said first ring.

10. The firepit of claim 1, in which said base portion includes a plurality of legs for raising said platform off a supporting surface.

11. The firepit of claim 10, wherein said wall of said base portion extends below said platform, defining a lower annular space below the platform, and said legs are attached to said wall from within this annular space.

12. The firepit of claim 11, wherein each of said legs have one end in abutment with said platform for providing support thereto.

13. The firepit of claim 1, wherein said base portion and said lid support structure are substantially of sheet metal construction.

14. The firepit of claim 13, wherein said sheet metal is heavy gage steel sheeting.

15. The firepit of claim 13, wherein said sheet metal is coated with a fireproof material.

16. The firepit of claim 15 in which said fireproof material is a flame-resistant paint applied to said sheet metal.

17. The firepit of claim 1, wherein said lid support structure may be reversibly disassembled for storage in said base portion.

18. A firepit for the controlled containment and display of burning lava rocks, said firepit comprising:

a base portion having a platform and a platform surrounding wall with a lid-support connector on said wall, said platform and wall defining a space for a plurality of said lava rocks support on said platform, said base portion being substantially open at a top plane;

a lid support structure extending from the base portion, said lid support structure openly configured to provide a substantially unobstructed view of said platform and any lava rocks supported on said platform, said lid support structure having a receiver in receiving communication with said lid-support connector;

a lid supported on said lid support structure;

a gas line for providing fuel to said lava rocks, said gas line disposed upon the platform of said base portion;

a supply line for supplying said gas line with fuel from a source of fuel; and a regulator disposed between said gas line and said supply line for controlling the quantity of gas to said supply line.

19. The firepit of claim 18 wherein said lid-support connector is an annular groove and said receiver is a corresponding tongue.

20. The firepit of claim 18 wherein said lid-support connector is a tongue and said receiver is a corresponding annular groove.

* * * * *